United States Patent [19]

Rodriguez

[11] 3,967,325

[45] July 6, 1976

[54] HYGIENIC TOILET-SEAT

[75] Inventor: Ennio Chinio Rodriguez, New York, N.Y.

[73] Assignee: Lawrence Peska Associates, Inc., New York, N.Y. ; a part interest

[22] Filed: July 11, 1975

[21] Appl. No.: 595,213

[52] U.S. Cl. ..... 4/245
[51] Int. Cl.[2] ..... A47K 13/14
[58] Field of Search ..... 4/245, 244, 242, 243, 4/246, 247

[56] References Cited

UNITED STATES PATENTS

| | | | |
|---|---|---|---|
| 1,130,068 | 3/1915 | Cachal | 4/245 |
| 1,140,814 | 5/1915 | Graves | 4/245 |
| 1,194,073 | 8/1916 | Romine | 4/245 X |
| 1,203,454 | 10/1916 | Baird | 4/245 |
| 1,740,544 | 12/1929 | Kuehne | 4/245 |
| 2,160,100 | 5/1939 | Crawford | 4/245 |

FOREIGN PATENTS OR APPLICATIONS

| | | | |
|---|---|---|---|
| 158,202 | 1/1933 | Switzerland | 4/245 |

*Primary Examiner*—Henry K. Artis
*Attorney, Agent, or Firm*—Jack D. Slobod

[57] ABSTRACT

A hygienic toilet seat cover includes a holder element mounted at the rear of a toilet seat for carrying a stack of disposable sheets overlaying the toilet seat. The holder includes a pivotly mounted cover plate on which is pivotly mounted the usual toilet seat cover. The cover plate is mounted on torsional springs to urge the plate in horizontal position capturing a margin of the sheet stack. For replacing the sheets the cover plate is rotated to a vertical orientation in which it is maintained by a bent resilient edge of the plate which is deflected against a base member for the holder.

2 Claims, 3 Drawing Figures

HYGIENIC TOILET-SEAT

FIELD OF THE INVENTION

The present invention relates generally to dispensers for sanitary toilet seat coverings of a type in which a stack of such coverings are held overlaying the toilet seat. In its particular aspects, the present invention relates to a holder for the coverings, which is maintainable in one position for capturing the coverings and in another position to enable replacement or refilling of the coverings.

BACKGROUND OF THE INVENTION

In review of my joint invention with Luis M. Banzo Herrada, registered as Utility Model 197341 in Spain on Nov. 8, 1973, I have determined that certain modifications would improve its operation. In particular the retaining element for the sheets of toilet coverings was somewhat difficult to control when replacing or refilling the coverings. This difficulty arose from the inability to maintain the element in an upwardly rotated position while having a free hand for replacing the coverings secured thereby. Accordingly, the retaining element has been redesigned to obviate this difficulty.

OBJECTS OF THE PRESENT INVENTION

It is an object of the present invention to provide a holder for retaining a stack of sanitary toilet seat covering sheets overlaying a toilet seat, which holder, while being urged by a spring to a position engaging the sheets, may be self retained in a position allowing the sheets to be refilled or replaced.

It is a further object of the present invention to provide a toilet seat covering dispenser which is easy to use when dispensing or replacing toilet seat coverings.

SUMMARY OF THE INVENTION

Briefly, the aforementioned and other objects of the present invention are satisfied by providing a cover member at the rear end of a toilet seat for retaining a stack of disposable sheet coverings over the toilet seat. The holder includes a base member having a pair of upstanding pins for piercing the sheet stack near a margin thereof. To capture the sheets, a pivotly mounted cover member is mounted to lie over the pins when the cover member is oriented horizontally. Torsional springs are provided to urge the cover member to a horizontal orientaton.

To enable the sheets to be replaced, the cover member is rotated to a vertical orientation to expose the pins. The cover member is retained in a vertical orientation by a catch wherein a resilient bent edge of the cover member is cammed against the base member. This action permits the cover to maintain its vertical orientation permitting the use of two free hands to replace the sheets.

Other objects, features and advantages of the present invention will become apparent upon perusal of the following detailed description of the preferred embodiment thereof when taken in conjunction with the appended drawing wherein.

DETAILED DESCRIPTION

Figure 1:
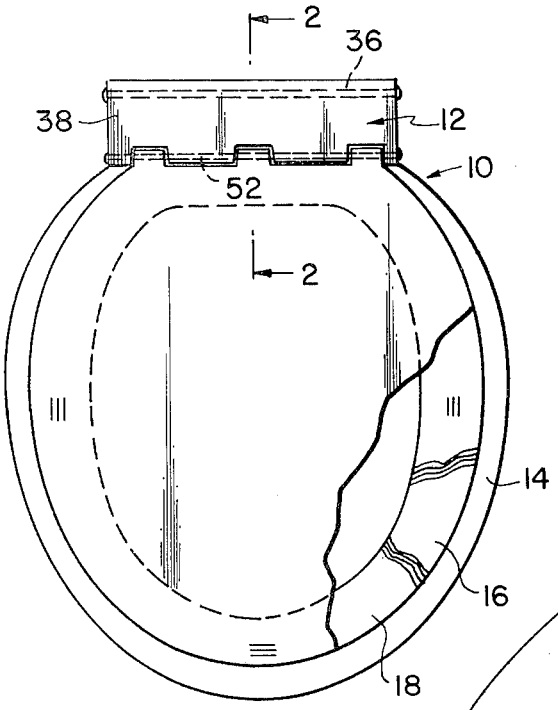
FIG. 1 is a partially broken away plan view of the hygienic toilet seat cover of the present invention.
Figure 2:
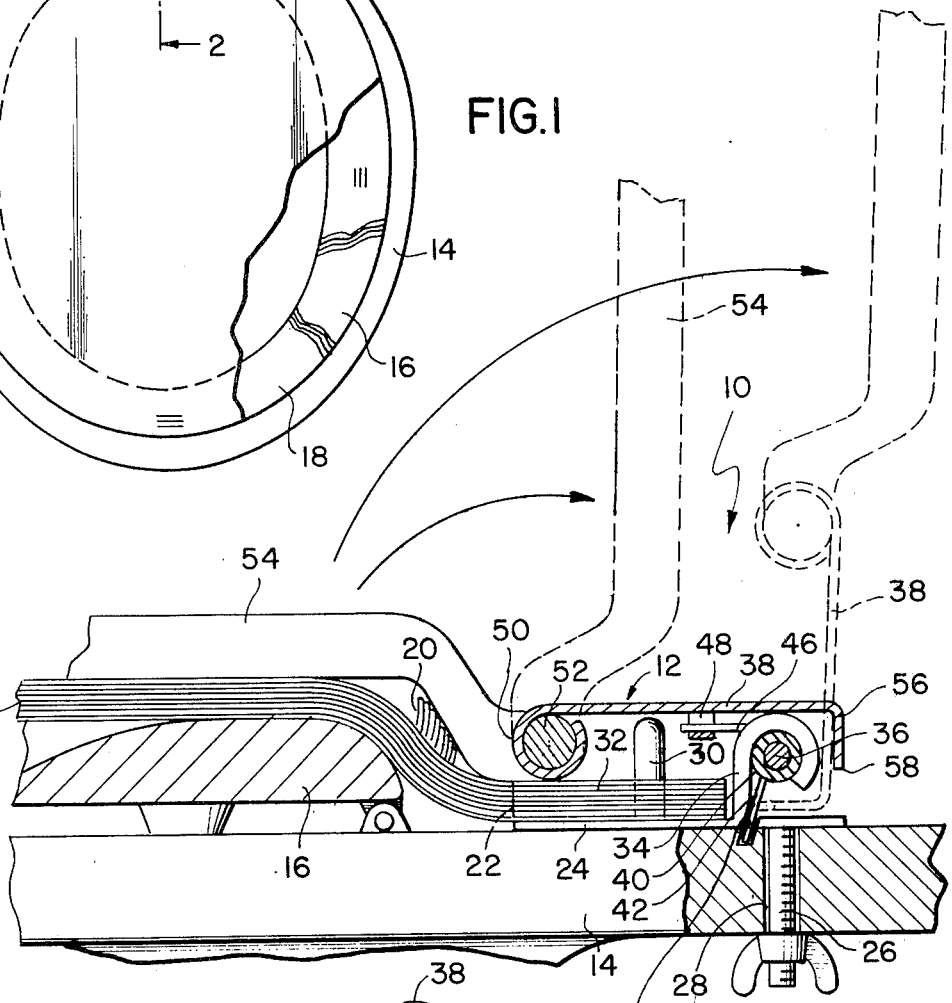
FIG. 2 is a cross-sectional side view of the hygienic toilet seat cover taken along the line 2—2 in FIG. 1 and showing an open position of a cover member in dashed lines.
Figure 3:
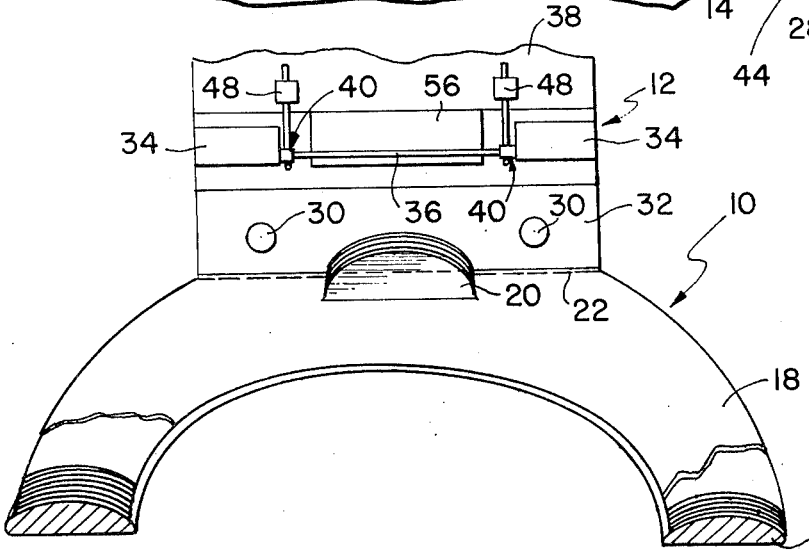
FIG. 3 is a partial enlarged pictorial presentation, generally similar to FIG. 1 but with the cover member in an open position.

Referring to FIGS. 1 through 3 of the drawing, the hygienic toilet seat cover 10 of the present invention comprises a holder 12 on top of a toilet 14 at the rear of a toilet seat 16. The holder 12 retains a stack of disposable annular shaped paper seat coverings 18 on top of seat 16 which conform to the shape of the seat. After use of toilet 14, the topmost sheet in the stack 18 is removed by grasping tab 20 projecting from the sheet and tearing the sheet along perforated line 22 to expose a fresh sheet.

The holder includes a base plate 24 mounted on the back end of toilet 14 with integral studs 26 which project downward through the usual anchor bolt holes 28 in toilet 14. A pair of spaced apart pins 30 project upwards from base plate 24 and pierce a rectangular tab 32 of the disposable sheets 18. The tab 32 forms a rear end of sheets 18 and is separated by the line of perforation 22 from the portions of the sheets which overlay seat 16.

A pair of transversely spaced apart journals 34 project upward from base plate 24 and carry between them a shaft 36 which serves as an axle for a sheet metal cover plate 38. The shaft 36 is located near the rear line of base plate 24 and serves as a core for a pair of torsional springs 40. Each spring 40 includes a downwardly projecting leg 42 which is captured in a recess 44 in base plate 24, and a leg 46 secured at 48 to the underside of cover plate 38. The springs 40 urge cover plate 38 to a horizontal orientation.

The front edge of cover plate 38 comprises a colinear series of yoke 50, carrying an axle 52 which serves as a hinge for supporting a conventional toilet cover 54. Yoke series 50 is positioned normally just behind line of perforations 22 to enable sheets 18 to be torn along the perforations. The cover 54 is adapted to either lie on top of sheets 18 or be rotated upwards about front axle 52 to expose toilet 14 for use.

It should be apparent from FIG. 2, that the cover plate 38 in its normal horizontal orientation, lies just above pins 30 to capture the tabs 32 of the sheets 18 within holder 12. For refilling holder 12 with a fresh stack of sheets 18, the cover plate 38 is rotated about the rear axle 36 to a vertical orientation exposing the pins 30 and tabs 32. To enable the tab residues of sheets 18 to be removed and the new sheet coverings 18 to be installed utilizing two hands, the cover plate 38 is self-maintaining in a vertical orientation.

To accomplish this, the center part of the rear edge of cover plate 38 includes a rectangular tab 56 which is bent downwardly at a slightly obtuse angle from plate 38. The tab 56 serves as a resilient catch having a tapered camming surface 58 for deflecting the tab to lie along the base plate 24 as the cover plate 38 is rotated to a vertical orientation. This catch means holds the cover plate 38 in a vertical orientation against the urging of springs 40 allowing easy replacement of sheets 18.

Having described the preferred embodiment of the present invention it should be apparent that numerous modifications, additions and omissions in the details thereof are possible within the intended spirit and scope of the invention as indicated by the following claims.

What is claimed is:

1. A cover apparatus for maintaining a stack of sanitary sheets overlaying a toilet seat comprising a holder for receiving a margin of said stack of sanitary sheets, means for mounting said holder in back of said toilet seat, a cover member pivotly mounted on said holder, said cover member being rotatable between a generally horizontal orientation for capturing said sheet margin and a generally vertical orientation for exposing said sheet margin to enable replacement of said sheets, spring means for urging said cover member to a horizontal orientation and resilient catch means carried by said cover member for maintaining said cover member in a vertical orientation against the urging of said spring means.

2. The apparatus of claim 1 wherein said holder includes a base member and wherein said catch means comprises a bent edge of said cover member which is deflected to engage said base member.

* * * * *